US009715863B2

(12) United States Patent
Rakow et al.

(10) Patent No.: US 9,715,863 B2
(45) Date of Patent: Jul. 25, 2017

(54) SCALE FACTOR BASED ON VIEWING DISTANCE

(71) Applicant: Microsoft Technology Licensing, LLC, Redmond, WA (US)

(72) Inventors: Matthew Allen Rakow, Seattle, WA (US); Matthew J. Esquivel, Sammamish, WA (US); Yining Chen, Bellevue, WA (US); Aditya Vijay Govindarajan, Redmond, WA (US); Amos Eshel, Seattle, WA (US); Stephen H. Wright, Bothell, WA (US); Che-Wen Lo, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 130 days.

(21) Appl. No.: 14/042,276

(22) Filed: Sep. 30, 2013

(65) Prior Publication Data

US 2015/0091947 A1 Apr. 2, 2015

(51) Int. Cl.
*G09G 5/373* (2006.01)

(52) U.S. Cl.
CPC ..... *G09G 5/373* (2013.01); *G09G 2320/08* (2013.01); *G09G 2340/045* (2013.01); *G09G 2354/00* (2013.01)

(58) Field of Classification Search
None
See application file for complete search history.

(56) References Cited

U.S. PATENT DOCUMENTS

| | | | | |
|---|---|---|---|---|
| 8,994,649 | B2 * | 3/2015 | Takamura et al. | 345/156 |
| 2008/0074444 | A1 * | 3/2008 | Morikawa et al. | 345/660 |
| 2009/0115783 | A1 * | 5/2009 | Eichenlaub | G02B 27/2221 345/421 |
| 2009/0147004 | A1 * | 6/2009 | Ramon et al. | 345/428 |
| 2009/0201516 | A1 * | 8/2009 | Takahashi | G09G 5/006 358/1.9 |
| 2009/0305204 | A1 * | 12/2009 | Connolly et al. | 434/219 |
| 2010/0061190 | A1 * | 3/2010 | Nelson | 368/10 |
| 2012/0254779 | A1 * | 10/2012 | Ollivierre et al. | 715/764 |

(Continued)

OTHER PUBLICATIONS

Author: Boris Smus, Title: High DPI Images for Variable Pixel Densities, Date: Aug. 22, 2012, pp. 16, Source: http://www.html5rocks.com/en/mobile/high-dpi/.*

(Continued)

*Primary Examiner* — Jwalant Amin

(57) ABSTRACT

Techniques for scale factor based on viewing distance are described. In at least some embodiments, a viewing distance refers to a distance at which a user typically views and/or is viewing a display device. For instance, different displays can be used in different ways and for different purposes, and thus may have different viewing distances. Techniques discussed herein consider the estimated viewing distance of a particular display in determining a scale factor to be applied to visual elements (e.g., graphics) for output via the particular display. A scale factor, for instance, can specify that visual elements are to zoomed-out or zoomed-in prior to be displayed. As detailed herein, this enables a consistent viewing experience to be maintained across different devices with different display sizes and different viewing distances.

20 Claims, 8 Drawing Sheets

(56) References Cited

U.S. PATENT DOCUMENTS

| | | | | |
|---|---|---|---|---|
| 2012/0287163 | A1* | 11/2012 | Djavaherian | 345/667 |
| 2012/0293399 | A1* | 11/2012 | Haskin | 345/88 |
| 2013/0027614 | A1 | 1/2013 | Bayer et al. | |
| 2013/0063492 | A1 | 3/2013 | Washington et al. | |
| 2015/0029064 | A1* | 1/2015 | Pan | H01Q 1/22 343/720 |

OTHER PUBLICATIONS

"High DPI Support", Retrieved from: <http://msdn.microsoft.com/en-us/library/ie/dn265030> on Jul. 2, 2013, (Jun. 26, 2013), 2 pages.
"Supporting Multiple Screens", Retrieved from: <http://developer.android.com/guide/practices/screens_support.html> on Jul. 2, 2013, (May 14, 2010), 16 pages.
Sorvig, Morten J., "Retina Display Support for Mac OS, iOS and X11", Retrieved from: <http://blog.qt.digia.com/blog/2013/04/25/retina-display-support-for-mac-os-ios-and-x11/> on Jul. 2, 2013, (Apr. 25, 2013), 12 pages.

* cited by examiner

SCALE FACTOR BASED ON VIEWING DISTANCE

BACKGROUND

Today's user has many options when it comes to selecting a computing device. Further, most users have multiple different devices that can be used depending on a use scenario. For instance, a user may have a desktop computer at work, a smartphone for use when on-the-go, and a tablet computer for home use.

While the availability of different devices provides for computing functionality in a variety of scenarios, it presents challenges in terms of how content is to be displayed on the different devices. For instance, different devices typically have different screen sizes and/or display resolutions. Further, different devices are often associated with different typical viewing distances. Thus, specifying how a particular instance of content (e.g., a webpage) is to be displayed on the different devices to provide a user with a satisfying user experience can be challenging.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Techniques for scale factor based on viewing distance are described. In at least some embodiments, a viewing distance refers to a distance at which a user typically views and/or is viewing a display device. For instance, different displays can be used in different ways and for different purposes, and thus may have different viewing distances. Techniques discussed herein consider the estimated viewing distance of a particular display in determining a scale factor to be applied to visual elements (e.g., graphics) for output via the particular display. A scale factor, for instance, can specify that visual elements are to zoomed-out or zoomed-in prior to be displayed. As detailed herein, this enables a consistent viewing experience to be maintained across different devices with different display sizes and different viewing distances.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Techniques for scale factor based on viewing distance are described. In at least some embodiments, a viewing distance refers to a distance at which a user typically views and/or is viewing a display device. For instance, different displays can be used in different ways and for different purposes, and thus may have different viewing distances.

For instance, a user may view a large screen television from one distance (e.g., approximately 10 feet), while the user may view a display of a tablet computer from a closer distance, e.g., approximately 16 inches. Techniques discussed herein consider the estimated viewing distance of a particular display in determining a scale factor to be applied to visual elements (e.g., graphics) for output via the particular display. A scale factor, for instance, can specify that visual elements are to zoomed-out or zoomed-in prior to be displayed. As detailed below, this enables a consistent viewing experience to be maintained across different devices with different display sizes and different viewing distances.

According to various embodiments, a viewing distance for a display is estimated. The viewing distance can be estimated in a variety of different ways, such as by determining characteristics of the display and correlating the characteristics to a known viewing distance for displays with similar characteristics. Other ways of determining viewing distance can be employed, such as using a proximity sensor, a position sensor, and so forth. A viewing distance along with other characteristics for a display (e.g., pixel density) are used to calculate a scale factor for the display. Example ways of calculating scale factor using viewing distance and other display characteristics are detailed below.

In the following discussion, an example environment is first described that is operable to employ techniques described herein. Next, a section entitled "Determining Scale Factor" describes some embodiments for determining scale factor to be applied to visual elements. Following this, a section entitled "Determining Viewing Distance" describes some example embodiments for determining viewing distance for displays. Next, a section entitled "Example Procedures" describes some example methods for scale factor based on viewing distance in accordance with one or more embodiments. Finally, a section entitled "Example System and Device" describes an example system and device that are operable to employ techniques discussed herein in accordance with one or more embodiments.

Example Environment

Figure 1:
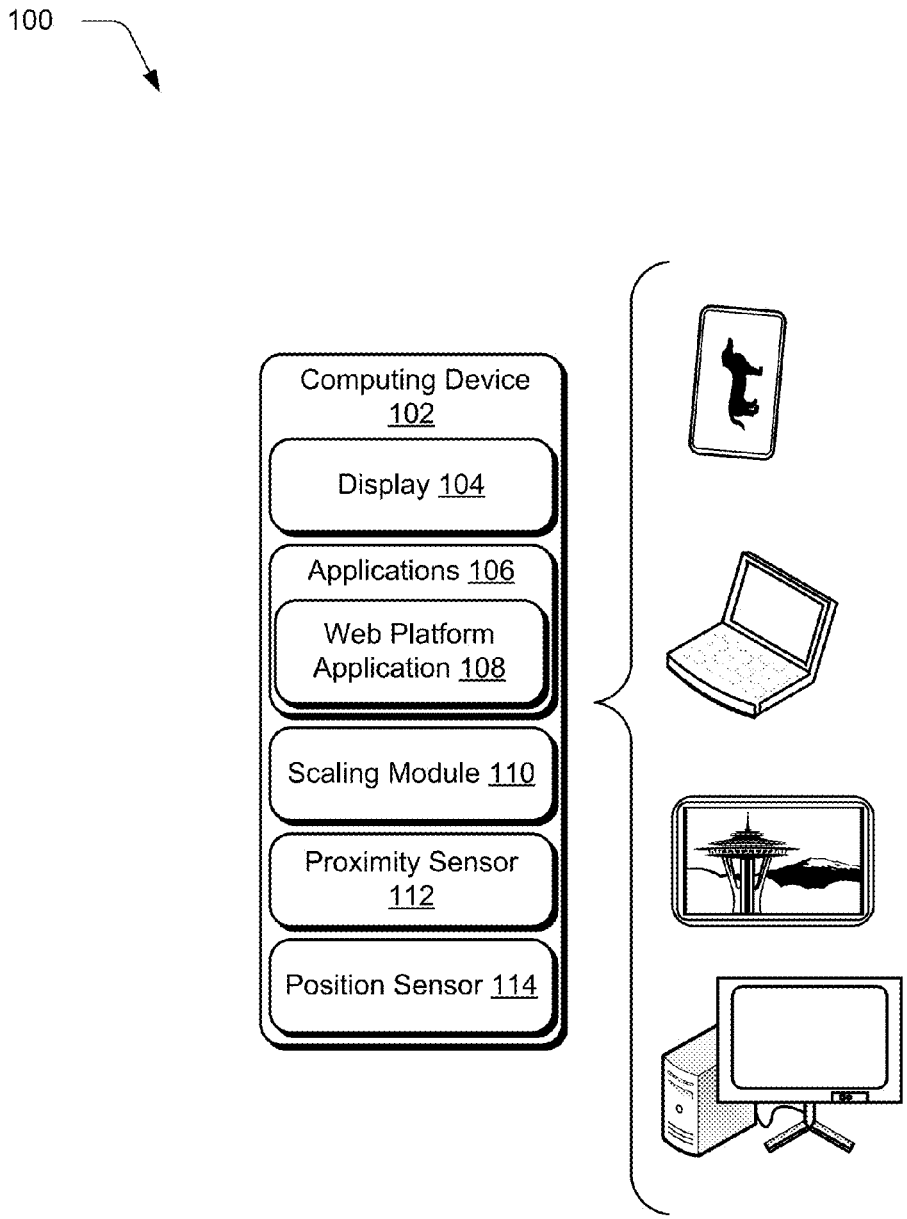
FIG. 1 is an illustration of an environment in an example implementation that is operable to employ techniques discussed herein in accordance with one or more embodiments.

FIG. 1 is an illustration of an environment 100 in an example implementation that is operable to employ techniques for scale factor based on viewing distance described herein. The environment 100 includes a computing device 102 that may be configured in a variety of ways. For example, the computing device 102 may be configured as a traditional computer (e.g., a desktop personal computer, laptop computer, and so on), a mobile station, an entertainment appliance, a television, a mobile phone, a netbook, a game console, a handheld device (e.g., a tablet), and so forth as further described in relation to FIG. 10.

The computing device 102 includes a display 104, which is representative of functionality for displaying graphics for the computing device 102. The display can be configured in a variety of sizes and according to a variety of different display technologies. Examples of the display 104 include a liquid crystal display (LCD), a light-emitting diode (LED) display, a plasma display, an organic LED (OLED) display, and so forth.

The computing device 102 further includes applications 106, which are representative of functionalities to perform various tasks via the computing device 102. Examples of the applications 106 include a word processor application, an email application, a content editing application, a gaming application, and so on.

The applications 106 include a web platform application 108, which is representative of an application that operates in connection with web content. The web platform application 108, for example, can include and make use of many different types of technologies such as, by way of example and not limitation, uniform resource locators (URLs), Hypertext Transfer Protocol (HTTP), Representational State Transfer (REST), HyperText Markup Language (HTML), Cascading Style Sheets (CSS), JavaScript, Document Object Model (DOM), as well as other technologies. The web platform application 108 can also work with a variety of data formats such as Extensible Application Markup Language (XAML), Extensible Markup Language (XML), JavaScript Object Notation (JSON), and the like. Examples of the web platform application 108 include a web browser, a web application (e.g., "web app"), and so on. According to various embodiments, the web platform application 108 is configured to present various types of web content, such as webpages, web documents, interactive web content, and so forth.

The computing device 102 further includes a scaling module 110, which is representative of functionality to perform various aspects of techniques for scale factor based on viewing distance discussed herein. For example, the scaling module 110 can calculate a scale factor to be applied to graphics that are displayed on the display 104, such as graphics for the applications 106. Various ways for determining a scale factor are detailed below. In at least some embodiments, the scaling module 110 can be implemented as part of an operating system, a rendering engine, and/or other graphics management functionality for the computing device 102.

The computing device 102 further includes a proximity sensor 112 and a position sensor 114. The proximity sensor 112 is representative of functionality to detect a specific and/or general proximity of the computing device 102 to another object, such as a user. The proximity sensor 112, for example, includes hardware and/or logic for detecting and processing proximity information. For instance, the proximity sensor 112 includes a light source for generating light, such as an infrared (IR) light source. The proximity sensor 112 may also include a light detector for detecting incident light, such as an IR light detector, a camera and/or cameras, and so forth. This is not intended to be limiting, however, and the proximity sensor 112 may employ a variety of different proximity sensing technologies and techniques in accordance with various embodiments.

The position sensor 114 is representative of functionality for determining a relative position of the computing device 102. For instance, the position sensor 114 includes hardware and/or logic for determining a position of the computing device 102 relative to a user and/or other surface. The position sensor 114, for example, can detect whether the display 104 is positioned in a portrait viewing position, a landscape viewing position, and so forth. The position sensor 114 can utilize various types of position sensing technologies, such as using gyroscopes, accelerometers, rotary encoders, and so forth.

In at least some embodiments, the position sensor 114 can detect relative positions of different portions of the computing device 102. For example, consider an embodiment of the computing device 102 that includes an input device that can be positioned in different orientations relative to the display 104. The input device, for example, can be a keyboard that is attached to the display 104 and that can be rotated to different positions relative to the display 104, such as to support different use scenarios. In such embodiments, the position sensor 114 can detect a position of the keyboard relative to the display 104. As discussed below, the position of an input device relative to the display 104 can be considered by the scaling module 110 in determining how to scale graphics that are displayed on the display 104.

In at least some embodiments, aspects of the techniques discussed herein can be implemented dynamically, such as in response to different events. For example, consider that the scaling module 110 is installed on the computing device 102, such as part of an operating system install. After installation of the scaling module 110, procedures discussed below can be employed to calculate a scale factor for the computing device 102 and apply the scale factor to graphics that are output via the display 104. Thus, in at least some embodiments, a scale factor calculated according to techniques discussed herein is different than a native display resolution, and thus causes a change in the way graphics are displayed on a particular display.

Further, consider that a user changes a display for a device. For instance, a user may connect a different display than the display 104 to the computing device 102. In a laptop or tablet device scenario, for example, a user may connect an external monitor. In response to a change in a display, procedures discussed below can be employed to determine information about the new display such that a scale factor for the new display can be calculated and employed to scale graphics for the new display. Thus, techniques discussed herein provide for scale factor calculation and application in a variety of different scenarios. Further, the techniques are dynamic and can adjust to changes in display scenarios, such as changes in viewing distance for a display, changes in a type of display being utilized by a particular computing device, and so forth.

Having described an example environment in which the techniques described herein may operate, consider now a discussion of some example embodiments for determining scale factor.

Determining Scale Factor

The following discussion describes example scenarios for determining scale factor in accordance with one or more embodiments. The example scenarios may be employed in the environment 100 of FIG. 1, the system 1000 of FIG. 10, and/or any other suitable environment.

Figure 2:
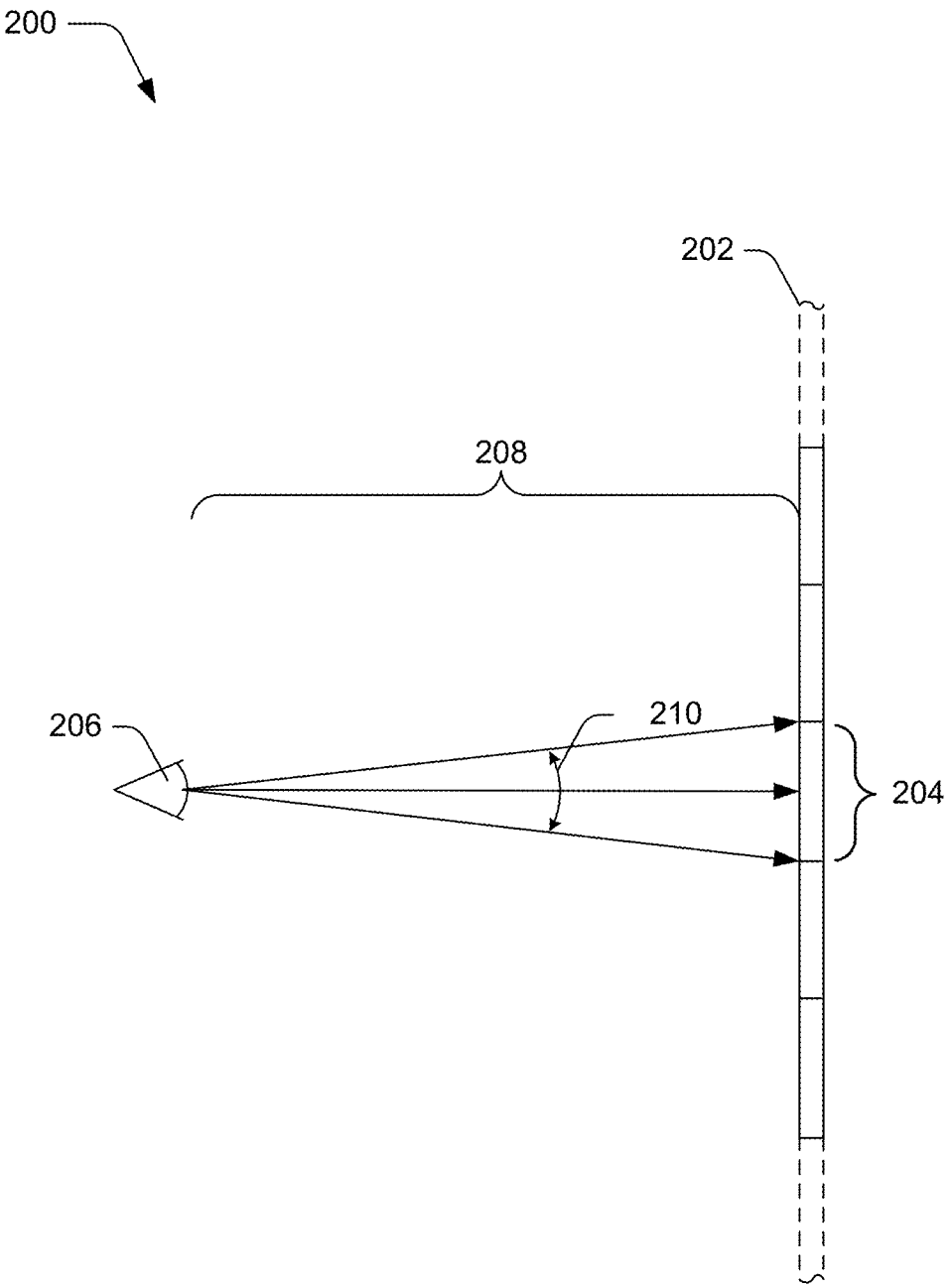
FIG. 2 illustrates an example implementation scenario in accordance with one or more embodiments.

FIG. 2 illustrates an example implementation scenario 200 in accordance with various embodiments. Generally, the scenario 200 describes various considerations that are taken into account with determining an appropriate scale factor to be applied to graphical elements on a display.

The scenario 200 includes a portion of a display 202. The display 202, for example, represents an implementation of the display 104 introduced above. The display 202 includes multiple pixels that make up a portion of the display on which graphics can be displayed, such as illustrated via a physical pixel 204. The pixels of the display 202 are not displayed to scale, and are exaggerated in size for purpose of illustration. Also illustrated is a human eye 206 which is viewing the display 202 from a viewing distance 208.

The display 202 is associated with a physical viewing angle 210, which generally corresponds to an angle at which the pixel 204 is viewed by the eye 206. For instance, movement of the eye 206 relative to the display 202 can cause the physical viewing angle 210 and/or the viewing distance 208 to change.

Generally, the width of the pixel 204, the viewing distance 208, and the physical viewing angle 210 are related. For instance, consider the following equation:

$$\frac{\left(\frac{\text{physical_pixel_width}}{2}\right)}{\text{view_distance}} = \tan\left(\frac{\text{physical_pixel_viewing_angle}}{2}\right) \qquad \text{Equation 1}$$

As discussed above, variations in the viewing angle 210 can cause inconsistencies in visual attributes of graphics displayed on the display 202. For instance, variations in one or more of the factors in the equation above can result in an unsatisfactory user viewing experience. Thus, embodiments discussed herein employ a scale factor that abstracts the physical viewing angle 210 into a logical viewing angle. For instance, consider the following implementation scenario.

Figure 3:
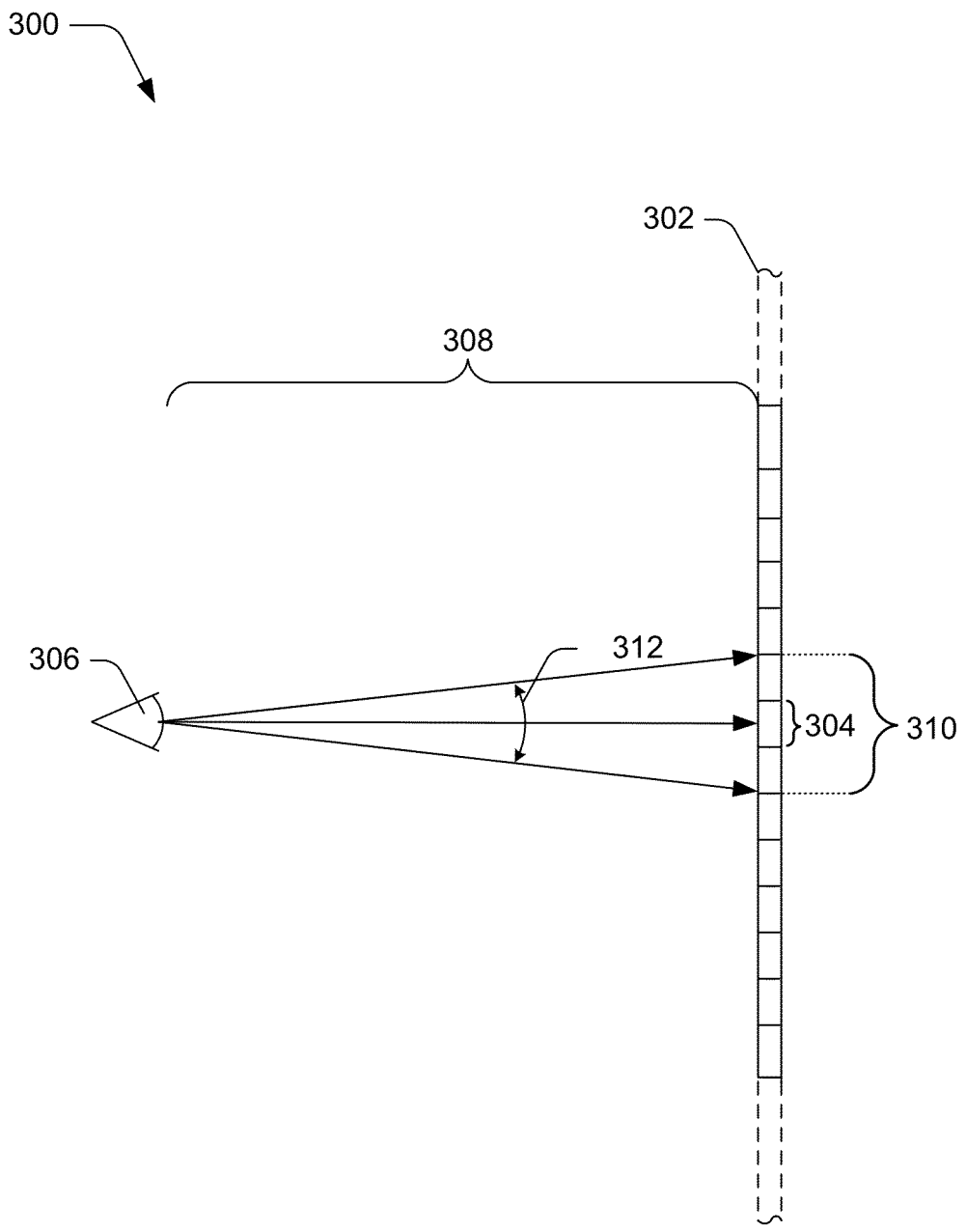
FIG. 3 illustrates an example implementation scenario in accordance with one or more embodiments.

FIG. 3 illustrates an example implementation scenario 300 in accordance with various embodiments. Generally, the scenario 300 describes an example way of using a scale factor to maintain a consistent viewing angle for a different pixel density (e.g., a higher resolution) display.

The scenario 300 includes a portion of a display 302. The display 302, for example, represents an implementation of the display 104 introduced above. The display 302 includes multiple pixels that make up a portion of the display 302 on which graphics can be displayed, such as illustrated via a physical pixel 304. The pixels of the display 302 are not displayed to scale, and are exaggerated in size for purpose of illustration. Also illustrated is a human eye 306 which is viewing the display 302 from a viewing distance 308.

As an example implementation, consider that the display 302 has a higher pixels per inch (PPI) that the display 202 discussed above. Further, consider that the same graphical image is to be displayed on both displays. For instance, absent any applied scaling, the same pixel data displayed on the physical pixel 204 of the display 202 will be displayed on the physical pixel 304 of the display 302. Still further, consider that the viewing distance 208 and the viewing distance 308 are the same or substantially the same.

To enable the viewing angle to remain substantially consistent between the display 202 and the display 302, a logical pixel 310 is defined. Generally, a logical pixel is defined based on a scaling (e.g., a zoom-out or zoom-in) of one or more physical pixels. The logical pixel 310, for example, consists of 3 physical pixels of the display 302. For instance, pixel data for a single pixel (e.g., the physical pixel 304) is zoomed such that it covers the logical pixel 310, e.g., 3 physical pixels. Thus, a scale factor of 3 (300% zoom) is applied to pixel data for the physical pixel 304 such that the pixel data covers to logical pixel 310. Correspondingly, the logical pixel 310 is associated with a viewing angle 312. The viewing angle 312, for instance, is the same or substantially the same as the viewing angle 210 discussed above.

Thus, according to the example scenario, the same pixel data displayed via the physical pixel 204 of the display 202 is displayed via the logical pixel 310 of the display 302. The pixel data, for instance, is scaled (e.g., zoomed) to fit the logical pixel 310. This enables the viewing angle 312 to remain substantially consistent with the viewing angle 210, and thus presents a substantially consistent viewing experience between the two displays.

In at least some embodiments, to generate the logical pixel 310, a scale factor is applied to physical pixels of the display 302. Generally, the scale factor can be described as:

$$\text{scale_factor} = \frac{\text{physical_pixels}}{\text{logical_pixels}} = \frac{\text{logical_pixel_width}}{\text{physical_pixel_width}} \qquad \text{Equation 2}$$

Equation 2 describes that the scale factor corresponds to a ratio of physical pixel width to logical pixel width.

In accordance with various embodiments, a scale factor is calculated to provide a consistent logical pixel view across varying pixel densities (e.g., PPIs) and varying view distances. Accordingly, in at least some implementations, a baseline viewing angle is specified against which different devices with different display attributes are normalized. In this particular discussion, the baseline view angle is based on a 96 PPI display with a view distance of 28 inches and at 100% scaling. Utilizing this baseline, a scale factor is calculated as:

$$\text{scale_factor} = 1.0 * \frac{\text{physical_PPI} * \text{view_distance}}{96\ \text{dpi} * 28''} \qquad \text{Equation 3}$$

$$\text{scale_factor} = \frac{\text{physical_PPI} * \text{view_distance}}{2688}$$

With physical_PPI being the pixel density of the target display, and view_distance being the determined viewing distance for the target display. Details concerning determining viewing distance for a device and/or a display are discussed below. Thus, Equation 3 (hereinafter "Scaling Equation") can be applied to an arbitrary display to determine a scale factor to be applied to the display to provide an optimal viewing angle.

As mentioned above, Equation 3 is determined based on a baseline viewing angle of a 96 PPI display with a view distance of 28 inches and at 100% scaling. This baseline is presented for purpose of example only, and embodiments may employ a different baseline (e.g., different PPI, different view distance, and/or different scaling) within the spirit and scope of the discussed embodiments.

In at least some embodiments, a scale factor determined via the Scaling Equation for a particular display can be rounded, such as to provide for scale factors that fall within a predictable variation. For instance, implementations may round calculated scale factors by increments of 25% based on an initial scale factor of 100%.

For example, consider that a scale factor of 1.10 (110% zoom) is determined for a display. Instead of applying the 1.10 scale factor, the scale factor can be rounded down based on the 25% rounding increment to 1.0 (100% zoom) such that no scaling is applied. For another display, a scale factor of 1.39 (139% zoom) may be determined. Instead of applying the 1.39 scale factor, the scale factor is rounded up based on the 25% rounding increment to 1.50 (150% zoom). The rounding increment of 25% is presented for purpose of example only, and any suitable rounding increment can be applied in accordance with one or more embodiments.

According to various embodiments, applying rounding to scale factors enables a predictability to be introduced into application of scaling. For instance, this allows developers and other entities to produce graphics (e.g., for applications) according to a predictable variation in scaling.

Have discussed some example embodiments for determining a scale factor, consider now a discussion of example ways for determining a viewing distance in accordance with one or more embodiments.

Determining Viewing Distance

As illustrated above, estimated viewing distance for a particular display is utilized to determine a scale factor to be applied to graphics for the display. Viewing distance can be determine in a variety of ways.

For instance, viewing distance can be determined based on heuristics that take into account various characteristics of a display. Characteristics of a display, for example, can be correlated to empirically-determined viewing distance for similar displays. For instance, consider the following table:

TABLE 1

| View dist. | Diagonal | Special | Form Factor |
|---|---|---|---|
| 16.3" | <9" | | Phone, small tablets |
| 20" | <13" | Native resolution not 1024 × 600 | Large tablets |
| 24.5" | <15" | | Laptops |
| 24.5" | <18" | Integrated panel | Laptops |
| 28" | >=15" | External display | Desktop monitors |
| 28" | >=18" | | Desktop monitors/AIOs |
| 7' * | Any | External Native vert res <768 or 1080i exception for 1024 × 600) | TVs |
| 7' * | >30" | 1080p timings or 4K timings Audio available in EDID | TVs |
| Force 100% scale factor | Unknown | EDID available, but no size specified | Projector |
| . . . | . . . | . . . | . . . |

Information from the "Diagonal" column, the "Special" column, and the "Form Factor" column can be ascertained from a display and/or a device to which a display is connected. For instance, an Extended Display Identification Data (EDID) element and/or other data structure for a display can be inspected to determine information for a display. Information ascertained about a display can be correlated to the table to determine a view distance from the "View Distance" column to be applied to the scale factor equation. The view distances included in the "View Distance" column, for example, can be based on known typical viewing distances for displays with the same and/or similar characteristics.

The information included in Table 1 is presented for purpose of example only, and a variety of other types of information can be determined for a display, such as resolution (e.g., PPI), display type, luminance data, and so forth.

While viewing distance may be determined based on known attributes of a device (such as discussed above), embodiments may utilize different techniques for determining viewing distance. For instance, viewing distance may be determined utilizing a proximity sensor, such as the proximity sensor 112 discussed above with reference to the environment 100.

In at least some embodiments, viewing distance can be determined based on a position of a display and/or a device associated with a display. For instance, a position of a display and/or an associated device can be determined via a position sensor, such as the position sensor 114 discussed above with reference to the environment 100. Further details concerning correlating position to viewing distance are presented below. Thus, viewing distance may be determined via different techniques and/or combinations of different techniques.

Having discussed some example ways for determining viewing distance, consider now a discussion of some example procedures in accordance with one or more embodiments.

Example Procedures

The following discussion presents some example procedures for performing various aspects of techniques for scale factor based on viewing distance. The procedures can be implemented in any suitable environment, such as the environment 100 discussed above with reference to FIG. 1, the system 1000 discussed below with reference to FIG. 10, and so forth.

Figure 4:
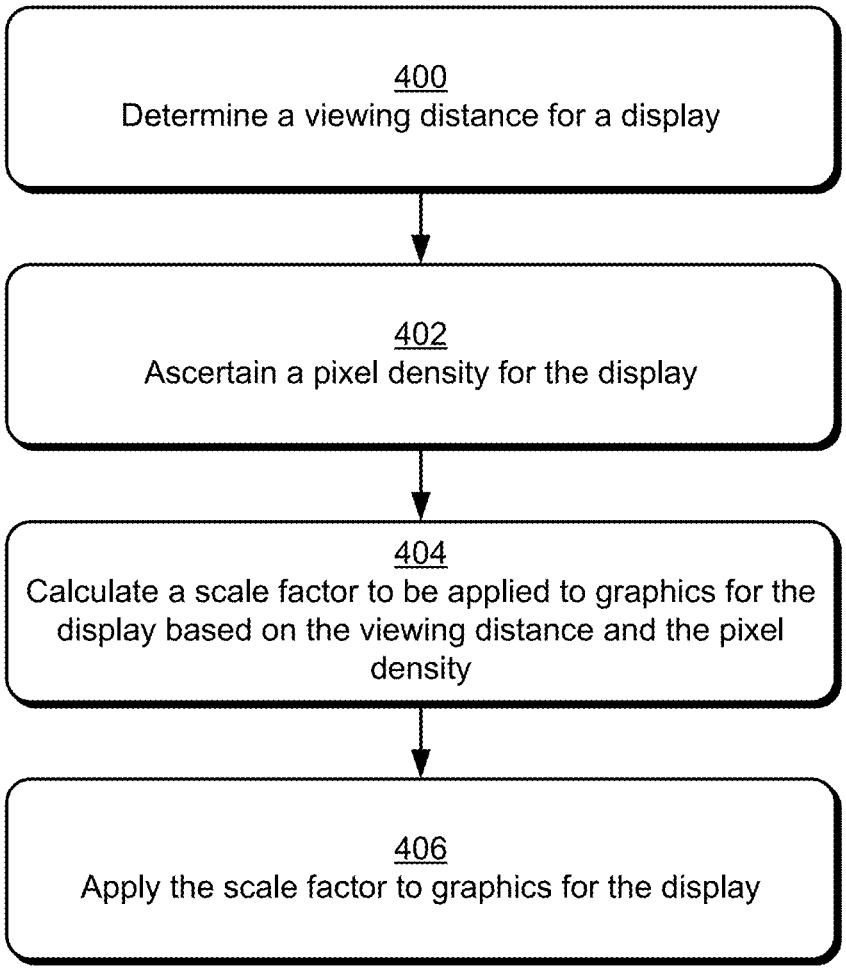
FIG. 4 is a flow diagram that describes steps in a method in accordance with one or more embodiments.

FIG. 4 is a flow diagram that describes steps in a method in accordance with one or more embodiments. The method, for instance, describes an example way of determining a scale factor to be applied to a device in accordance with various embodiments.

Step 400 determines a viewing distance for a display. Example ways of estimating a viewing distance of a display are discussed above and below. Step 402 ascertains a pixel density for the display. As discussed above, pixel density can be determined in a variety of ways, such as by inspecting an EDID element and/or other configuration data for a display.

Step 404 calculates a scale factor to be applied to graphics for the display based on the viewing distance and the pixel density. The viewing distance and the pixel density, for example, can be applied to the Equation 3 discussed above to ascertain a scale factor to be applied.

Step 406 applies the scale factor to graphics for the display. The scale factor, for instance, can be provided to a graphics processor, a display driver, and so forth, to be used to display graphics on a display.

According to various embodiments, user adjustment of display characteristics can be accommodated. For instance, a user can adjust the pixel density of a display to increase or decrease the number of pixels that are used to display graphics. In an event that a user changes the pixel density of a display, a scale factor can be recalculated for the display based on the adjusted pixel density according to techniques discussed herein.

In at least some embodiments, a user may override application of a scale factor to graphics on a display. For instance, after a scale factor is calculated and applied to graphics displayed on a display, a user may manually specify a different zoom level than that specified by the scale factor. In such a case, the display will be zoomed based on the user-specified zoom level. This enables a user to custom tune how graphics are displayed on a particular display.

Figure 5:
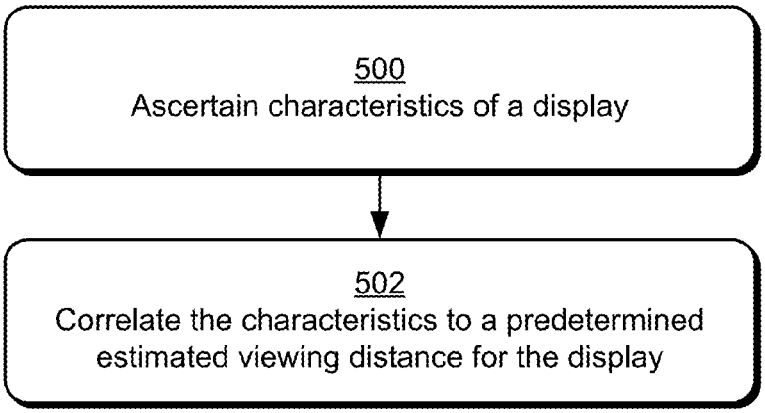
FIG. 5 is a flow diagram that describes steps in a method in accordance with one or more embodiments.

FIG. 5 is a flow diagram that describes steps in a method in accordance with one or more embodiments. The method, for instance, describes an example way of determining viewing distance for a display in accordance with various embodiments.

Step 500 ascertains characteristics of a display. For instance, the scaling module 110 discussed above with reference to the environment 100 can access information about the display, such as by inspecting an EDID element and/or other device data for the display.

Step 502 correlates the characteristics to a predetermined estimated viewing distance for the display. As discussed above, for instance, a table of correlations of display characteristics for particular types of displays to known estimated viewing distances for the particular types of displays can be maintained. When an unknown display is encountered, characteristics for the unknown display can be compared to the table to determine a best match type of display. Thus, a known estimated viewing distance for the best match type of display can be correlated to the unknown display.

Figure 6:
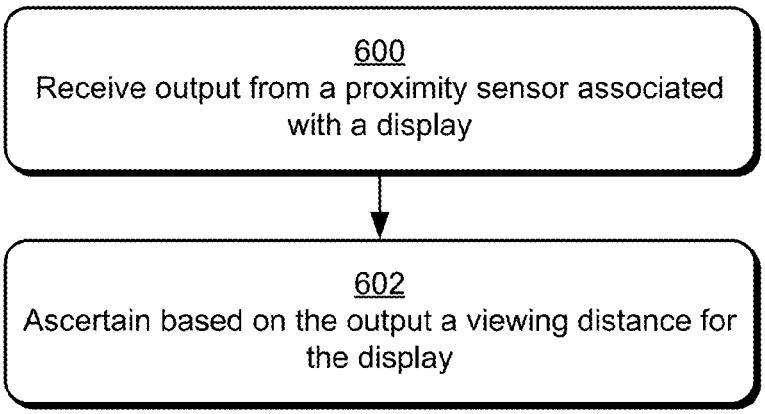
FIG. 6 is a flow diagram that describes steps in a method in accordance with one or more embodiments.

FIG. 6 is a flow diagram that describes steps in a method in accordance with one or more embodiments. The method, for instance, describes an example way of determining viewing distance for a display in accordance with various embodiments.

Step 600 receives output from a proximity sensor associated with a display. The proximity sensor, for example, is integrated into the display and/or a computing device associated with the display, such as the proximity sensor 112 discussed above.

Step 602 ascertains based on the output a viewing distance for the display. For instance, the output can correspond to a detected distance of a user from the display and/or an associated computing device.

Figure 7:
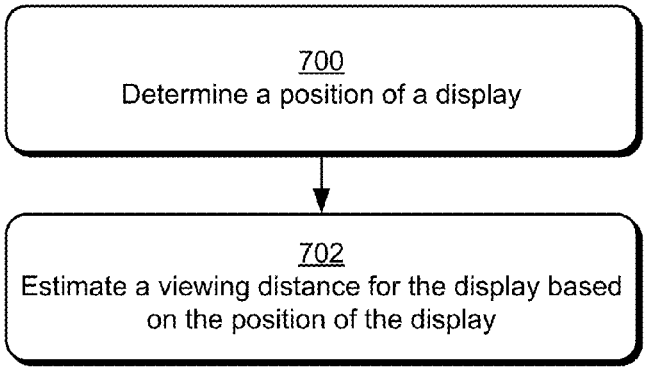
FIG. 7 is a flow diagram that describes steps in a method in accordance with one or more embodiments.

FIG. 7 is a flow diagram that describes steps in a method in accordance with one or more embodiments. The method, for instance, describes an example way of determining viewing distance for a display in accordance with various embodiments.

Step 700 determines a position of a display. The position, for instance, can be determined based on output from a position sensor, such as the position sensor 114 discussed above. The position sensor can be integrated into the display and/or a computing device associated with the display. The position, for instance, can correspond to a position of the display relative to the ground, such as whether the display is being viewed in a portrait view, a landscape view, perpendicular to the ground, parallel to the ground, and so forth.

As discussed above, the position can also be based on relative positions of different portions of a computing device. For instance, a computing device may include an input device (e.g., a keyboard) that is attached to a display and that can be positioned in different orientations relative to the display. The input device, for example, can be rotatably attached to the display via a hinge mechanism. Thus, in at least some embodiments, the position can correspond to an angle of the input device relative to the display.

Step 702 estimates a viewing distance for the display based on the position of the display. For example, different estimated viewing distances can be specified for different device positions, e.g., for a particular device.

As an example implementation, consider that a display of a portable device (e.g., a smartphone) is determined to be perpendicular or angled (e.g., approximately 45 degrees) relative to the ground. In at least some embodiments, this can indicate that the device is being used in a particular position, such as a handheld position. Thus, a particular viewing distance can be estimated for the particular position.

As another example, consider that the display of the portable device is determined to be parallel to the ground. In at least some embodiments, this can indicate that the device is being used in a different position, such as positioned on a surface such as a desk or a table. Thus, a different viewing distance can be estimated for the portable device, e.g., different than when the device is perpendicular or angled relative to the ground. These example positions are presented for purpose of illustration only, and it is to be appreciated that a variety of different positions can be utilized to estimate viewing distance in accordance with various embodiments.

In embodiments that consider relative positions of different portions of a computing device, the relative positions can indicate a particular usage scenario and thus an estimated viewing distance. For instance, consider a device that includes a keyboard rotatably attached to a display. In at least one position, the keyboard can be positioned in front of the display, such as in a typing position to enable a user to interact with a document displayed on the device via input to the keyboard. The typing position can be associated with a particular viewing distance, such as based on the assumption that the user is positioned relative to the keyboard such that the user can provide input to the keyboard.

Consider further that the keyboard is rotated behind the display or detached from the display, e.g., in detachable keyboard implementations. This can indicate a handheld position, such that a user is holding the display portion and viewing content on the display. Thus, a different viewing distance can be specified for the handheld position, such as based on the assumption that the user is holding and viewing the display portion.

These device positions are presented for purpose of example only, and it is to be appreciated that a wide variety of other device positions and viewing distances can be employed in accordance with various embodiments.

In at least some embodiments, a scale factor can be changed in response to a change in viewing distance. For instance, consider the following example procedure.

Figure 8:
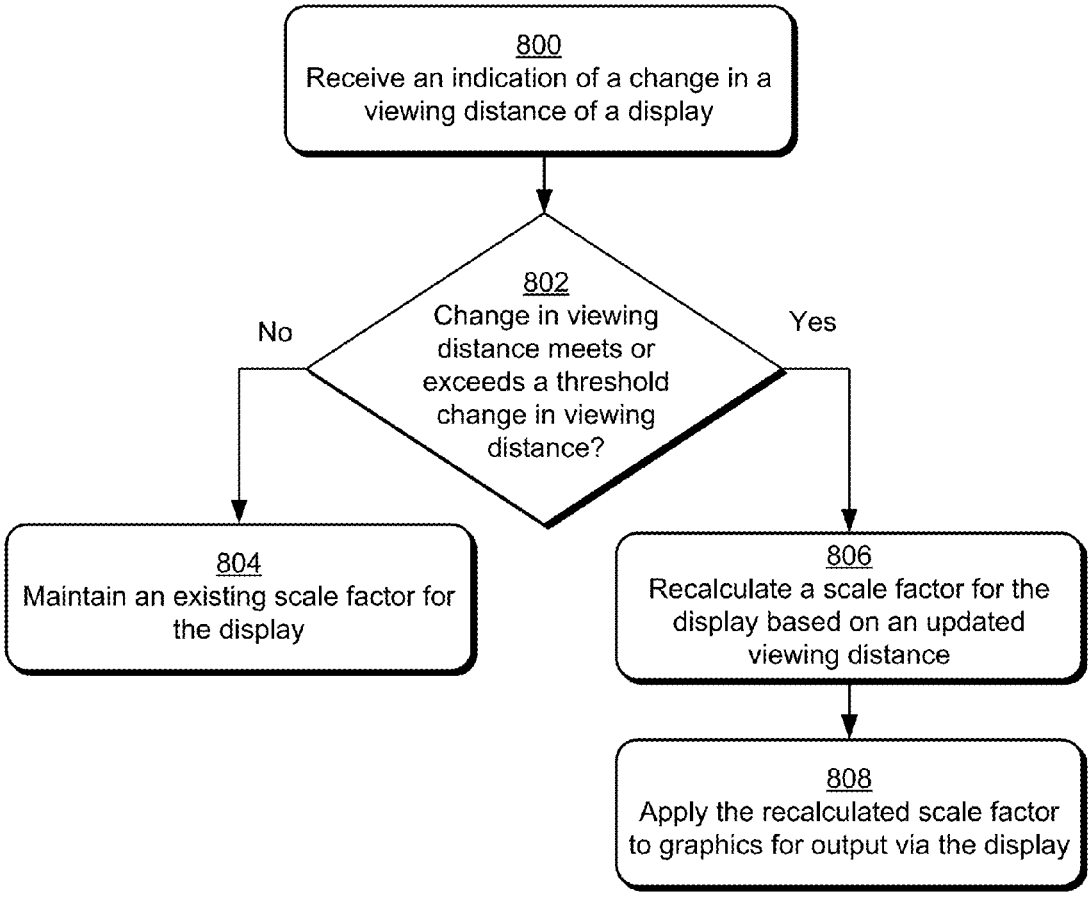
FIG. 8 is a flow diagram that describes steps in a method in accordance with one or more embodiments.

FIG. 8 is a flow diagram that describes steps in a method in accordance with one or more embodiments. The method, for instance, describes an example way of determining whether to change a scale factor in response to a change in viewing distance in accordance with various embodiments.

Step 800 receives an indication of a change in a viewing distance of a display. The indication, for example, can be received from a proximity sensor, such as the proximity sensor 112. For instance, a user can move closer or further away from a computing device and/or a display of the computing device. A proximity sensor can detect the movement and generate a notification of the change in viewing distance, e.g., a notification to the scaling module 110.

Alternatively or additionally, the indication of the change can be based on a change in a position of the display, such as detected by the position sensor 114. For instance, a portable device can be repositioned from being perpendicular to the ground to being parallel to the ground, such as in response to being placed on a surface such as a desk or a table. As discussed above, different display positions can be associated with different viewing distances. Thus, the change in display position can result in a change in viewing distance.

A change in display position can also be caused by a change in position relative to an associated computing device. For instance, for a display that can be repositioned (e.g., rotated) relative to an associated input device (e.g., a keyboard), a change in relative display position can indicate a change in a usage scenario. For instance, a user can go from editing a document display on a display via input to an associated keyboard, to viewing content on the display. Accordingly, the user can reposition the keyboard to a position more suitable for viewing content, such as by rotating the keyboard behind the display, or by detaching the keyboard. The change in relative position of the display to the keyboard can cause a change in viewing distance, e.g., a change in viewing distance correlated to the display based on its relative position.

Step 802 ascertains whether the change in viewing distance meets or exceeds a threshold change in viewing distance. In at least some embodiments, a threshold change in viewing distance can be pre-specified. The threshold change, for example, can be specified as a discrete distance, such as in centimeters, inches, feet, and so forth. Alternatively or additionally, the threshold change can be specified as a percentage of a previous-determined (e.g., a currently in-force) viewing distance, such as 10%, 25%, and so on.

If the change in viewing distance does not meet or exceed the threshold change ("No"), step 804 maintains an existing scale factor for the display. For instance, a previously-determined and applied scale factor for the display is not changed.

If the change in viewing distance meets or exceeds the threshold change ("Yes"), step 806 recalculates a scale factor for the display based on an updated viewing distance. A new viewing distance, for example, can be determined. The new viewing distance can be determined in a variety of ways, examples of which are discussed above. A scaling equation (e.g., Equation 3, above) can be reevaluated using the updated viewing distance.

Step 808 applies the recalculated scale factor to graphics for output via the display. Graphics data, for example, can be zoomed-in or zoomed-out based on the recalculated scale factor prior to being output on the display.

According to various embodiments, using a threshold change in viewing distance to determine whether to update a scale factor prevents minor fluctuations in viewing distance from causing a rescaling of graphics on a display.

At least some embodiments may also utilize a time threshold in combination with a threshold change in viewing distance. For example, if a change in viewing distance does not last for at least a threshold period of time, a rescaling will not be applied based on the change in viewing distance, e.g., even if the change in viewing distance meets or exceeds a threshold change in viewing distance. However, if a change in viewing distance exceeds a threshold change in viewing distance and a threshold period of time (e.g., duration), a scale factor can be recalculated based on the new viewing distance. A threshold period of time can be specified as a number of seconds and/or any other suitable time unit.

Applying both a threshold change in viewing distance and a threshold period of time for the change in view distance further prevents short-term (e.g., very brief) changes in viewing distance from causing a rescaling of graphics on a display.

While the procedure discussed above applies a threshold distance and/or a threshold period of time to a change in viewing distance, some alternative embodiments may simply recalculate a scale factor in response to a change in viewing distance without applying a threshold change in viewing distance or threshold period of time.

In at least some embodiments, content can be rescaled in response to transitioning between displays. For instance, consider the following example procedure.

Figure 9:
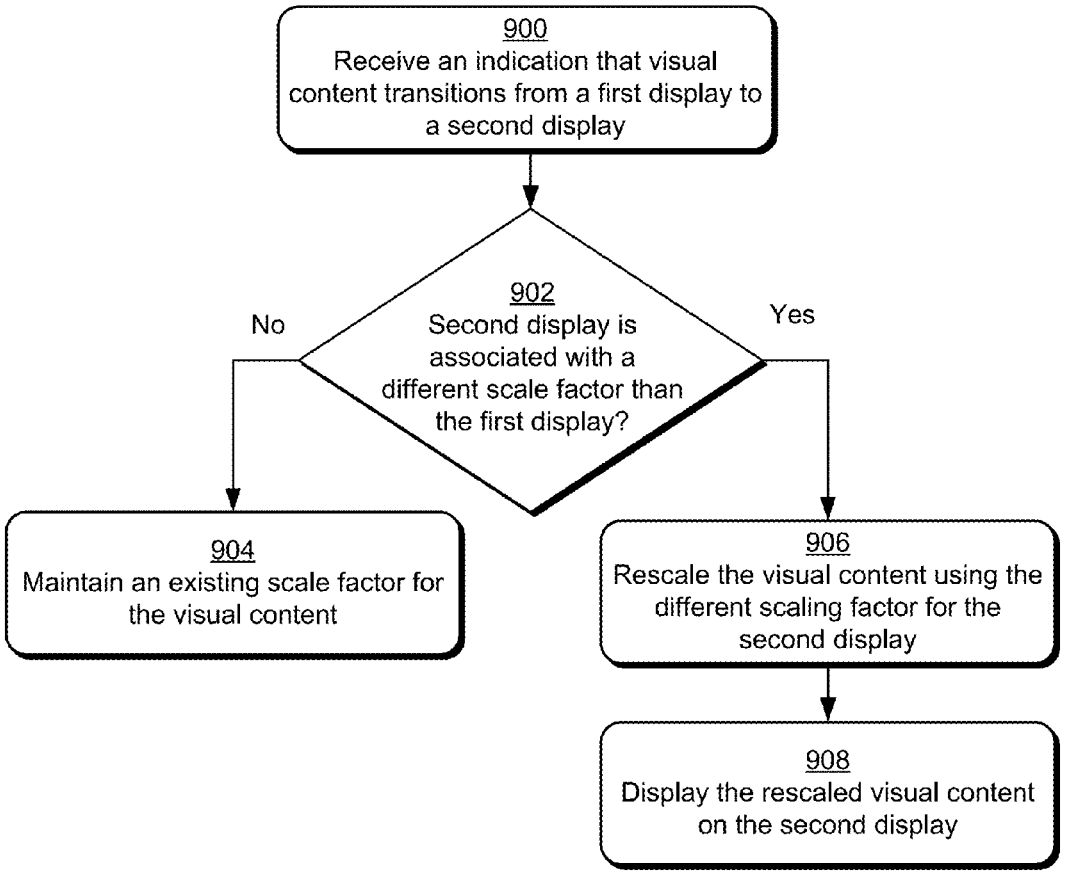
FIG. 9 is a flow diagram that describes steps in a method in accordance with one or more embodiments.

FIG. 9 is a flow diagram that describes steps in a method in accordance with one or more embodiments. Step 900 receives an indication that visual content transitions from a first display to a second display. For instance, some devices have multiple displays, and thus visual content can be moved between the multiple displays. Visual content, for example, can be dragged from one display to another display via user input. Content may also be sent from one device with particular display attributes, to a different device with different display attributes. In at least some embodiments, the visual content is scaled based on a particular scale factor for the first display.

Step 902 ascertains whether the second display is associated with a different scale factor than the first display. The second display, for example, may have a different viewing distance, different display size, different resolution, and/or other display attribute that differs from that of the first display.

If the second display is not associated with a different scale factor than the first display ("No"), step 904 maintains an existing scaling for the visual content. For instance, a scaling factor that is applied to the visual content for display on the first display, can be used to scale the visual content for display on the second display.

If the second display is associated with a different scale factor than the first display ("Yes"), step 906 rescales the visual content using the different scaling factor for the second display. Step 908 displays the rescaled visual content on the second display.

According to various embodiments, the procedures discussed herein can be performed automatically and independent of user interaction. For instance, the detection and application of different scale factors can occur automatically, e.g., in response to visual content being presented for display and/or moved from one display to another.

Having discussed some example procedures, consider now a discussion of an example system and device in accordance with one or more embodiments.

Example System and Device

Figure 10:
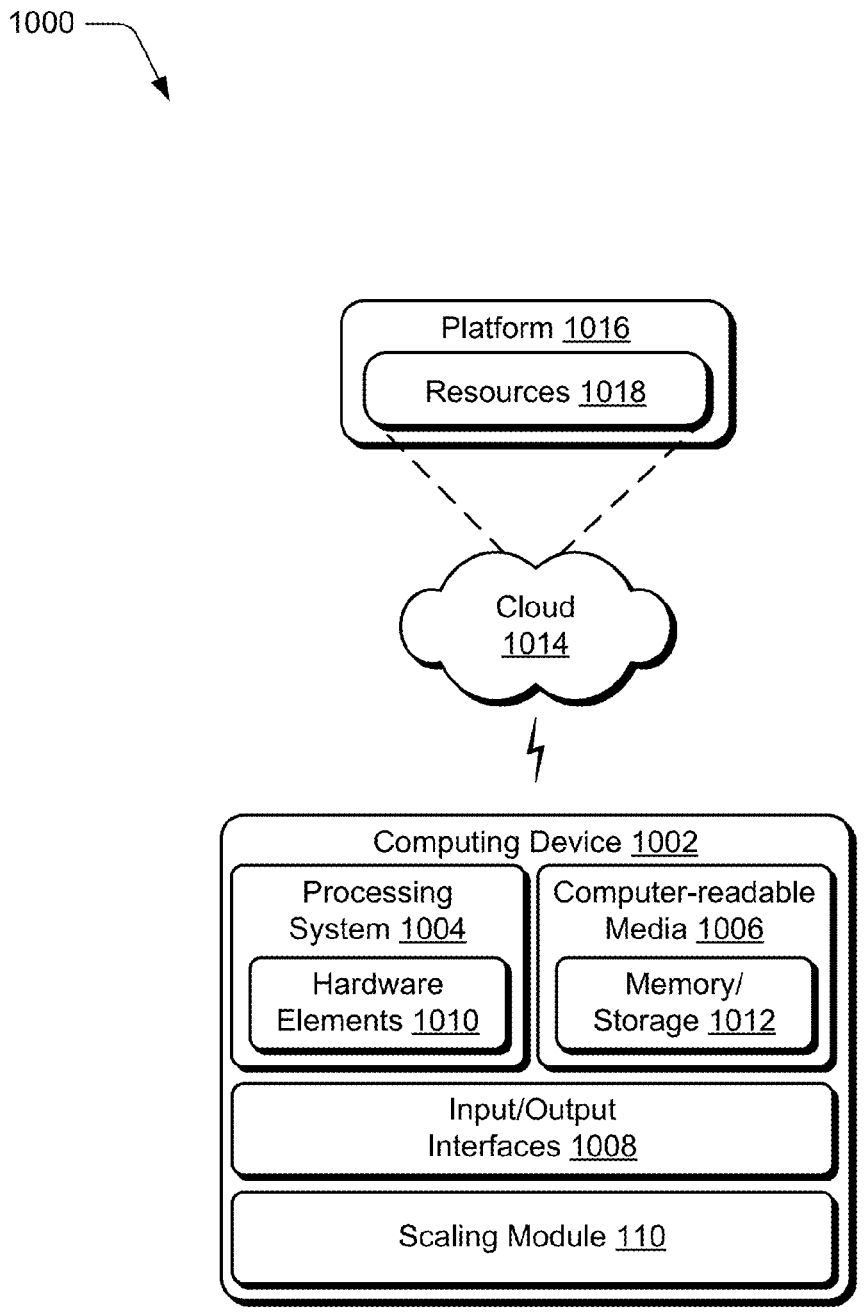
FIG. 10 illustrates an example system and computing device as described with reference to FIG. 1, which are configured to implement embodiments of techniques described herein.

FIG. 10 illustrates an example system generally at 1000 that includes an example computing device 1002 that is representative of one or more computing systems and/or devices that may implement the various techniques described herein. This is illustrated through inclusion of the scaling module 110, which may be employed to implement techniques for scale factor based on viewing distance discussed herein. The computing device 1002 may be, for example, a server of a service provider, a device associated with a client (e.g., a client device), an on-chip system, and/or any other suitable computing device or computing system.

The computing device 1002 as illustrated includes a processing system 1004, one or more computer-readable media 1006, and one or more I/O interfaces 1008 that are communicatively coupled and/or connected, one to another. Although not shown, the computing device 1002 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 1004 is representative of functionality to perform one or more operations using hardware. Accordingly, the processing system 1004 is illustrated as including hardware elements 1010 that may be configured as processors, functional blocks, and so forth. This may include implementation in hardware as an application specific integrated circuit or other logic device formed using one or more semiconductors. The hardware elements 1010 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable media 1006 are illustrated as including memory/storage 1012. The memory/storage 1012 represents memory/storage capacity associated with one or more computer-readable media. The memory/storage 1012 may include volatile media (such as random access memory (RAM)) and/or nonvolatile media (such as read only memory (ROM), Flash memory, optical disks, magnetic disks, and so forth). The memory/storage 1012 may include fixed media (e.g., RAM, ROM, a fixed hard drive, and so on) as well as removable media (e.g., Flash memory, a removable hard drive, an optical disc, and so forth). The computer-readable media 1006 may be configured in a variety of other ways as further described below.

Input/output interface(s) 1008 are representative of functionality to allow a user to enter commands and information to computing device 1002, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 1002 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 1002. By way of example, and not limitation, computer-readable media may include "computer-readable storage media" and "computer-readable signal media."

"Computer-readable storage media" refer to media and/or devices that enable persistent storage of information in contrast to mere signal transmission, carrier waves, or signals per se. Thus, computer-readable storage media do not include signals per se. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" refer to a signal-bearing medium that is configured to transmit instructions to the hardware of the computing device 1002, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 1010 and computer-readable media 1006 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 1010. The computing device 1002 may be configured to implement particular instructions and/or functions corresponding to the software and/or hardware modules. Accordingly, implementation of a module that is executable by the computing device 1002 as software may be achieved at least partially in hardware, e.g., through use of computer-readable storage media and/or hardware elements 1010 of the processing system 1004. The instructions and/or functions may be executable/operable by one or more articles of manufacture (for example, one or more computing devices 1002 and/or processing systems 1004) to implement techniques, modules, and examples described herein.

The techniques described herein may be supported by various configurations of the computing device 1002 and are not limited to the specific examples of the techniques described herein. This functionality may also be implemented all or in part through use of a distributed system, such as over a "cloud" 1014 via a platform 1016 as described below.

The cloud 1014 includes and/or is representative of a platform 1016 for resources 1018. The platform 1016 abstracts underlying functionality of hardware (e.g., servers) and software resources of the cloud 1014. The resources 1018 may include applications and/or data that can be utilized while computer processing is executed on servers that are remote from the computing device 1002. Resources 1018 can also include services provided over the Internet and/or through a subscriber network, such as a cellular or Wi-Fi network.

The platform 1016 may abstract resources and functions to connect the computing device 1002 with other computing devices. The platform 1016 may also serve to abstract scaling of resources to provide a corresponding level of scale to encountered demand for the resources 1018 that are implemented via the platform 1016. Accordingly, in an interconnected device embodiment, implementation of functionality described herein may be distributed throughout the system 1000. For example, the functionality may be implemented in part on the computing device 1002 as well as via the platform 1016 that abstracts the functionality of the cloud 1014.

Discussed herein are a number of methods that may be implemented to perform techniques discussed herein. Aspects of the methods may be implemented in hardware, firmware, or software, or a combination thereof. The methods are shown as a set of blocks (e.g., steps) that specify operations performed by one or more devices and are not necessarily limited to the orders shown for performing the operations by the respective blocks. Further, an operation shown with respect to a particular method may be combined and/or interchanged with an operation of a different method in accordance with one or more implementations. Aspects of the methods can be implemented via interaction between various entities discussed above with reference to the environment 100, the system 1000, and so on.

CONCLUSION

Techniques for scale factor based on viewing distance are described. Although embodiments are described in language specific to structural features and/or methodological acts, it is to be understood that the embodiments defined in the appended claims are not necessarily limited to the specific features or acts described. Rather, the specific features and acts are disclosed as example forms of implementing the claimed embodiments.

What is claimed is:

1. A system comprising:

one or more processors; and one or more computer-readable storage media storing computer-executable instructions that, responsive to execution by the one or more processors, cause the system to perform operations including:

determining an estimated viewing distance for a display based on an angle of an input device relative to the display, the input device being attached to the display and being positionable at different positions relative to the display;

ascertaining a pixel density for the display; and calculating a scale factor to be applied to graphics for the display based on the viewing distance and the pixel density.

2. A system as described in claim 1, wherein said calculating is performed using the equation:

$$\text{scale factor} = \frac{\text{pixel density} * \text{viewing distance}}{2688}.$$

3. A system as described in claim 1, wherein said determining further comprises:

ascertaining characteristics of the display; and correlating the characteristics to a predetermined estimated viewing distance for the display.

4. A system as described in claim 3, wherein said ascertaining comprises inspecting an Extended Display Identification Data (EDID) element for the display to determine one or more of the characteristics of the display.

5. A system as described in claim 1, wherein said determining further comprises:

receiving output from a proximity sensor associated with the display; and ascertaining based on the output the viewing distance for the display.

6. A system as described in claim 1, wherein said determining further comprises:

determining a position of the display; and estimating the viewing distance for the display based on the position of the display.

7. A system as described in claim 1, wherein the display is part of a computing device that includes the input device rotatably attached thereto and that is positionable in different positions relative to the display.

8. A system as described in claim 1, wherein the operations further comprise:

receiving an indication that visual content is transitioned from the display to a different display; and responsive to an indication that the different display is associated with a different scale factor, rescaling the visual content using the different scale factor.

9. A computer-implemented method, comprising:

determining an estimated viewing distance for a display based on one or more of an angle of an input device attached to the display that is positionable in different positions relative to the display or an orientation of the display relative to the ground;

ascertaining a pixel density for the display; and calculating a scale factor to be applied to graphics for the display based on the viewing distance and the pixel density.

10. A computer-implemented method as recited in claim 9, wherein said determining comprises:

ascertaining one or more of the angle of the input device relative to the display or the orientation of the display relative to the ground; and correlating the ascertained one or more of the angle or the orientation to a predetermined estimated viewing distance for the display.

11. A computer-implemented method as recited in claim 9, wherein said calculating is performed as:

$$\text{scale factor} = \frac{\text{pixel density} * \text{viewing distance}}{2688}.$$

12. A computer-implemented method as recited in claim 9, wherein said determining further comprises:

receiving output from a proximity sensor associated with the display; and ascertaining based on the output the viewing distance for the display.

13. A computer-implemented method as recited in claim 9, wherein the display is part of a computing device that includes the input device attached thereto and that is positionable in different positions relative to the display.

14. A computer-implemented method as recited in claim 9, further comprising applying the scale factor to the graphics by zooming the graphics based on the scale factor.

15. One or more computer-readable storage media having instructions stored thereon that, responsive to execution by one or more processors, cause the one or more processors to perform operations comprising:

determining an estimated viewing distance for a display based on an orientation of the display relative to the ground;

ascertaining characteristics of the display including a pixel density of the display; and correlating the characteristics to the estimated viewing distance for the display to calculate a scale factor for graphics to be output via the display.

16. One or more computer-readable storage media as recited in claim 15, wherein said ascertaining comprises inspecting an information element that includes attributes of the display to determine one or more of the characteristics of the display.

17. One or more computer-readable storage media as recited in claim 15, wherein the characteristics comprise one or more of a size or a resolution of the display.

18. One or more computer-readable storage media as recited in claim 15, the operations comprising calculating the scale factor as:

$$\text{scale factor} = \frac{\text{pixel density} * \text{viewing distance}}{2688}.$$

19. One or more computer-readable storage media as recited in claim 15, wherein the operations comprise:

calculating the scale factor; and applying the scale factor to the graphics prior to the graphics being output via the display.

20. One or more computer-readable storage media as recited in claim 15, wherein the operations comprise:

calculating the scale factor; and rounding the scale factor based on a predefined rounding increment prior to applying the scale factor to the graphics.

* * * * *